US007842375B2

(12) United States Patent
Vetters

(10) Patent No.: US 7,842,375 B2
(45) Date of Patent: Nov. 30, 2010

(54) FIBER RETENTION SYSTEM FOR METAL MATRIX COMPOSITE PREFORM

(75) Inventor: Daniel Kent Vetters, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1153 days.

(21) Appl. No.: 11/131,168

(22) Filed: May 17, 2005

(65) Prior Publication Data

US 2006/0263577 A1 Nov. 23, 2006

(51) Int. Cl.
*B32B 3/00* (2006.01)
*B32B 15/14* (2006.01)
*B64C 11/16* (2006.01)

(52) U.S. Cl. ..... 428/172; 428/167; 428/293.1; 416/230; 416/236 R

(58) Field of Classification Search ..... 428/167, 428/172, 293.1; 416/140, 170, 229 R, 230, 416/236 A, 236 R, 170 R; 267/171; 384/120, 384/221; 228/193, 262.1
See application file for complete search history.

(56) References Cited

U.S. PATENT DOCUMENTS 3,737,694 A * 6/1973 Rabenhorst ..... 310/74
3,737,976 A 6/1973 Lieberman et al.
4,782,992 A 11/1988 Doble
4,907,736 A 3/1990 Doble
5,184,769 A 2/1993 Moracz et al.
5,249,359 A 10/1993 Schubert et al.
5,289,967 A 3/1994 Bampton et al.
5,337,940 A 8/1994 Woods et al.
5,431,984 A 7/1995 Keck et al.
5,544,805 A 8/1996 Alassoeur et al.
5,562,245 A 10/1996 Berthelemy et al.
5,840,390 A 11/1998 Fujiwara
5,946,801 A 9/1999 Twigg et al.
6,232,688 B1 5/2001 Ress, Jr. et al.
6,247,638 B1 6/2001 Ress, Jr.
6,261,699 B1 7/2001 Ress, Jr. et al.
6,568,061 B2 5/2003 Hanusiak et al.
6,685,365 B2 2/2004 White
6,686,026 B2 * 2/2004 Spiewak et al. ..... 428/167
2002/0029845 A1 3/2002 Ress, Jr.
2002/0031678 A1 3/2002 Ress, Jr. et al.

* cited by examiner

*Primary Examiner*—Donald Loney
(74) *Attorney, Agent, or Firm*—Krieg DeVault LLP

(57) ABSTRACT

A metal matrix composite preform including an angled curved groove in the surface of the matrix material. A reinforcing fiber is placed within the angled curved groove and the stiffness of the fiber causes it to be pressed against an outer wall member defining the groove. The fiber is retained within the metal matrix composite preform prior to hot isostatic pressing.

17 Claims, 4 Drawing Sheets

A

FIBER RETENTION SYSTEM FOR METAL MATRIX COMPOSITE PREFORM

BACKGROUND OF THE INVENTION

The present invention relates generally to composite materials, and more specifically, to metal matrix composites (MMC).

Metal matrix composites include a continuous metallic phase, referred to as the matrix, combined with another phase, the reinforcement, to strengthen the metallic phase and increase high-temperature stability. The reinforcement is typically a ceramic in the form of particulates, platelets, whiskers or fibers.

Metal matrix composites find application in many fields including gas turbine engines. Many metal matrix composites are extremely strong, lightweight, and have significant resistance to extremes in temperature and in temperature changes. The properties associated with metal matrix composites are considered beneficial for application in rotating machinery such as turbo machinery rotors where component hoop stress can be significant.

The fabrication of metal matrix composites involves the placement of the reinforcement between layers of metallic sheet or foil. A stack of the material is then heated and isostatically pressed (HIP) or vacuum hot pressed (VHP) into a composite. One prior approach of laying up the material for the stack is to weave the reinforcing material into mats which are then located between the layers of metallic sheet or foil. Utilization of mats in fabricating metal matrix composites has generally required significant consolidation, that is, reduction in overall volume, when the composite is processed to its ultimate shape. The resulting metal matrix composite generally has a lower strength because of the lack of desired orientation in the reinforcement. An approach utilized to reduce the degree of consolidation in forming the metal matrix composite includes forming a plurality of grooves in the matrix. The reinforcement is located in and retained in the grooves with a binder/glue prior to the HIP or VHP operation. One limitation associated with the later approach is the increased risk of contamination associated with the out gassing during removal of the binder/glue.

While there are numerous prior techniques for forming metal matrix composite preforms, there remains a need for further development in this field of technology. The present invention satisfies this need, and others, in a novel and non-obvious way.

SUMMARY OF THE INVENTION

One form of the present invention contemplates a matrix composite preform comprising: a metallic or intermetallic body having an outer surface with a groove formed therein and having a first portion of the groove extending about an axis, the first portion defined by a first sidewall and a second sidewall that are both oriented at an acute angle relative to the outer surface, the second sidewall is located further from the axis than the first sidewall; and, a fiber reinforcement located in the first portion of the groove and internally biased against the second sidewall.

Another form of the present invention contemplates an apparatus comprising: a metallic or intermetallic material having a substantially planar outer surface with at least one groove formed therein about an axis; a reinforcing fiber located within the at least one groove; and the at least one groove including fiber retention means for retaining the reinforcing fiber therein.

In yet another form the present invention contemplates a method comprising: (a) forming at least one non-linear groove in a metallic or intermetallic sheet of material, the at least one groove including a first wall and a second wall spaced therefrom that are formed at an acute angle relative to an outer surface of the sheet of material; (b) placing a fiber reinforcement into the at least one groove, the fiber reinforcement being resiliently urged against one of the walls to retain the fiber reinforcement in the at least one groove; and (c) subjecting the sheet of material to heating and pressing acts after the placing to produce a matrix composite.

One object of the present invention is to provide a unique matrix composite preform.

DESCRIPTION OF THE PREFERRED EMBODIMENTS

Figure 1:
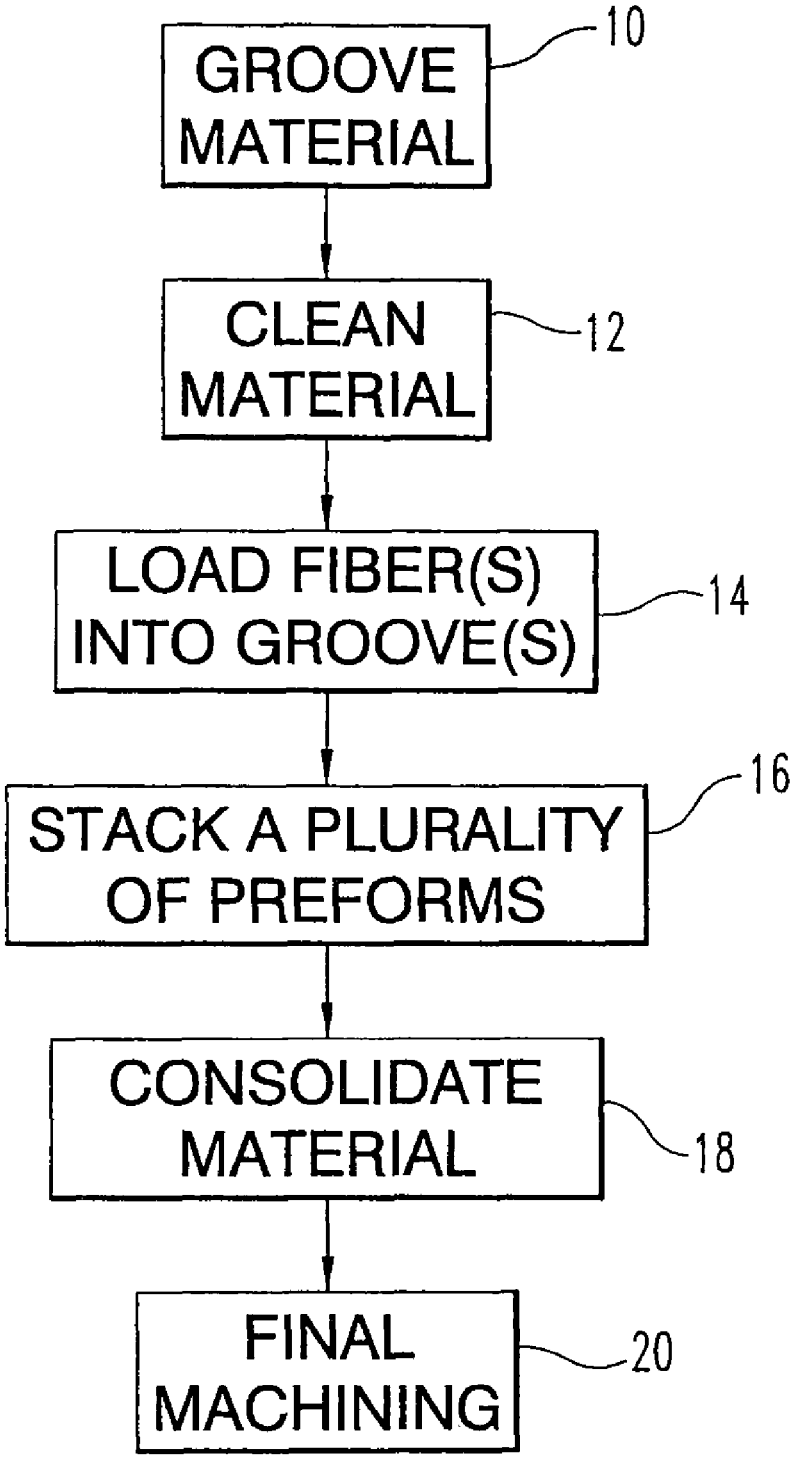
FIG. 1 is a block diagram illustrating one embodiment of a process for forming a metal matrix composite article.

For purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

With reference to FIG. 1, there is set forth a schematic diagram illustrating one method of forming an article of a metal matrix composite. The method described with reference to FIG. 1 is not intended herein to be limiting unless specifically provided to the contrary. The method includes an act 10 of forming a groove or grooves in the matrix material to be reinforced. The matrix material is generally of, but not limited, to a sheet or foil form and the grooves are formed by a variety of techniques including, but not limited to, cutting with a single point tool, waterjet grooving and/or chemical machining or etching. One non-limiting example of forming grooves in a matrix material is set forth in U.S. Patent Application Publication No. 2002/0029845, which is incorporated herein by reference. The present application is applicable with sheet material having grooves formed by the above techniques or other techniques.

The matrix material is cleaned in act 12 to remove any material particles and/or other contaminants after the grooving in act 10. A reinforcing fiber is loaded into the groove or reinforcing fibers are loaded into the grooves in act 14. In the text below there is described the self-retention of the fiber(s) within the groove(s) of the matrix material. In one form the present invention maintains the reinforcing fiber within the groove without requiring any binder/glue or other mechanical means prior to the act 18 of consolidation. The matrix material with the reinforcing fibers loaded therein in an unconsolidated state may be referred to as a preform. In act 16 one preform and another layer of matrix material are stacked together, or a plurality of preforms are stacked together. In a preferred form, a plurality of preforms are stacked one atop the other for further processing in act 18.

The stack of preforms from act 16 are then subjected to a consolidation operation in act 18 such as, but not limited to, hot isostatic pressing (HIP) or vacuum hot pressing (VHP). The consolidation operation generally causes a reduction in volume and bonding between the adjacent layers of matrix material. Other consolidation operations are contemplated herein as would be believed known to one of ordinary skill in the art. The consolidation act will be described herein with reference to a HIP process. The temperature and pressure in the HIP process will generally be dependent on the matrix material used in the metal matrix composite. On a general note, the temperature used in the HIP processing is high enough to soften the matrix material but below the matrix material's melting point and the pressure is sufficient to cause the softened material to flow around the reinforcing fiber. In one non-limiting example, a titanium alloy is subjected to temperatures within a range of 1400° F. to 2000° F. during the HIP processing. Typically pressures in the range of 10,000-15,000 PSI are used in the HIP processing. However, the selection of appropriate processing temperatures and pressures is believed within the capabilities of a person of ordinary skill. Once the HIP operation is completed, the metal matrix composite may be used in a net shape or may undergo further processing.

The matrix material is contemplated as being shaped in virtually any shape including, but not limited to, a sheet, a ring, a disk and three dimensional components including airfoil shapes. While the matrix material will be described herein with general reference to rings or sheets, it is understood that the description is applicable to all geometries/configurations unless specifically stated to the contrary. In one form the matrix material is formed so as to have at least one substantially flat outer surface; in another form the matrix material has two substantially flat outer surfaces. The matrix material can be selected from any of a variety of intermetallic materials, metallic materials, and/or metallic alloys. Typical materials to form the sheet or disk from include, but are not limited to, titanium alloys, iron-cobalt alloys, aluminum alloys, nickel alloys and/or cobalt alloys. The term matrix composite will include, but not limited to, any of the materials listed above and is not intended to be limited to metallic unless specifically provided to the contrary. The disk or sheet can have a variety of thicknesses and in one form the thickness is within a range of about 0.007 inches to 0.010 and in another form the disk or sheet has a thickness within a range of about 0.005 inches to about 0.015 inches. However, other sheet or disk thicknesses are contemplated herein. Further, in applications utilizing a plurality of sheets or disks of matrix materials the sheets or disks may have the same or different thicknesses.

The reinforcement is preferably a fiber and in one embodiment is an inorganic fiber. Fibers formed of ceramics, such as, but not limited to silicon carbide or alumina are contemplated herein. In one form the fibers are monofilament fibers; however, multifilament fibers are also contemplated herein. The fibers may be coated or uncoated and are believed generally known to those of ordinary skill in the art.

Figure 2:
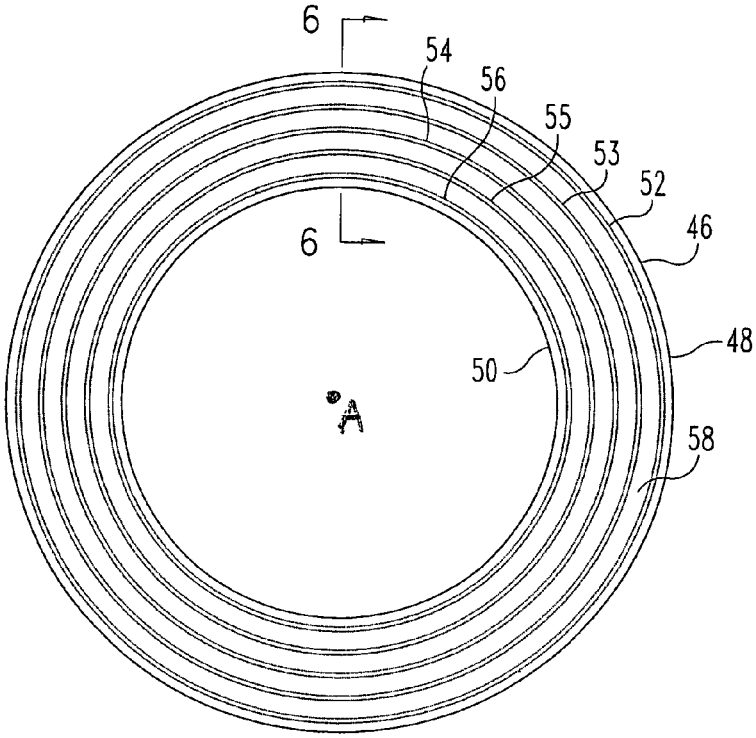
FIG. 2 is an illustrative plan view of a metal matrix composite ring comprising one embodiment of the present invention.
Figure 3:
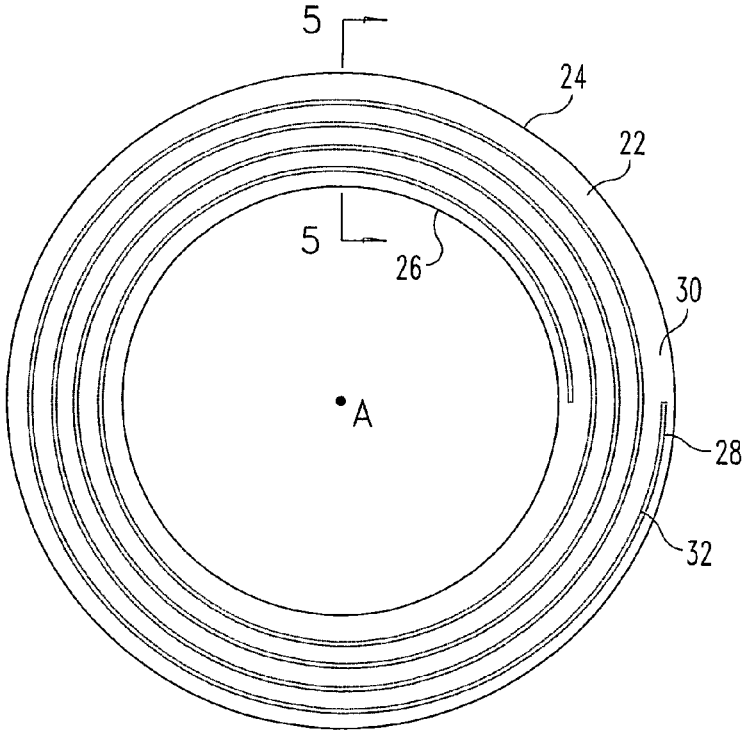
FIG. 3 is an illustrative plan view of a metal matrix composite ring comprising another embodiment of the present invention.

With reference to FIGS. 2 and 3, there are illustrated ring like sheets of matrix material applicable for forming a metal matrix composite. More specifically, with reference to FIG. 2, there is illustrated a ring 46 with a plurality of spaced grooves 52-56, and in FIG. 3 there is illustrated a continuous spiral grove 28 in sheet 22. The present invention contemplates that the plurality of spaced grooves 52-56 may be, but are not limited to, concentric grooves. Each of the sheets 22 and 46 has an outer diameter 24, 48 and an inner diameter 26, 50 respectively. The embodiments in FIGS. 2 and 3 of sheets 22 and 46 include the groove or grooves formed on one face. In an alternate embodiment of the present invention the groove or grooves are formed on both faces of the sheet. In order to simplify the representation of the material in FIGS. 2 and 3, the pitch or spacing of the spiral groove 28 or plurality of grooves 52-56 as shown is purely illustrative. In one form the pitch or spacing is much more finely spaced to increase the volume of reinforcing fibers relative to the matrix base metal. In one form the spacing of the reinforcing fibers is within a range of about 70 grooves per inch to about 140 grooves per inch. However, other spacing is contemplated herein. The present invention contemplates that the pitch or spacing of the groove or grooves may be uniform or may vary across the individual sheet or ring of matrix material. Further, the pitch or spacing of the groove or grooves may also vary between the individual sheets or rings of matrix material.

Figure 4:
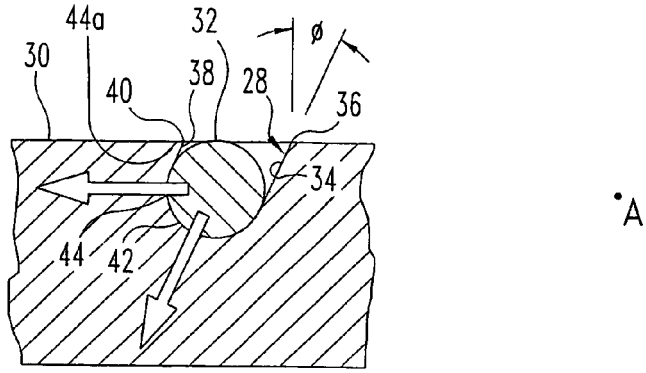
FIG. 4 is an enlarged cross-section view taken along a portion of lines 5-5 of FIG. 3.

With reference to FIG. 4, there is illustrated one embodiment of groove 28 applicable for retention of the reinforcing fiber 32 therein. The retention of the reinforcing fiber within the groove will be described with reference to the embodiment of FIG. 3; however the description is applicable to the other sheet configurations contemplated herein unless provided to the contrary.

In the embodiment of FIG. 4, groove 28 is of a curved configuration and has a central axis generally indicated by A. Groove 28 is shown as a spiral having different radii of curvatures about axis A for each segment of the groove; in all cases for this embodiment the axis A is located radially inward from the groove 28. Groove 28 includes a radially inward side wall 34, relative to axis A, extending to an edge 36 and a radially outward side wall 38, relative to Axis A extending to an edge 38. The radially outward side wall 38 is located further from axis A than the radially inward side wall 34. Each of the edges 36 and 38 are located at the face 40 of the ring 22.

A floor 42 extends between side walls 34 and 38. In one form the floor 40 is substantially curved to conform to the generally circular cross-section of reinforcing fiber 32. This match between the reinforcing fiber and the groove functions to minimize the consolidation that is required in act 18. However, the present application is not limited to those situations where the reinforcing fiber and the groove match. Floor 42 may be formed in configurations, including, but not limited to semi-circular, square cut, or square cut with fillet radii. In one form the side walls 34 and 38 are formed at an angle $\phi$ with respect to the face 30. The angle $\phi$ may be the same or different for each of the side walls, and/or for each of the spaced grooves. In one form the side walls 34 and 38 are parallel to one another; however, other relationships between the side walls are contemplated herein. A relatively wide range of angles $\phi$ are contemplated herein between the side walls 34 and 38 and the face 30. In one form angle ϕ is within a range of between 5° and 25°; however other angles are contemplated herein. In one form the formation of the side walls 34 and 38 at an angle ϕ results in the radially outermost portion 44 of floor 42 being located radially outward of edge 40 relative to axis A.

Figure 5:
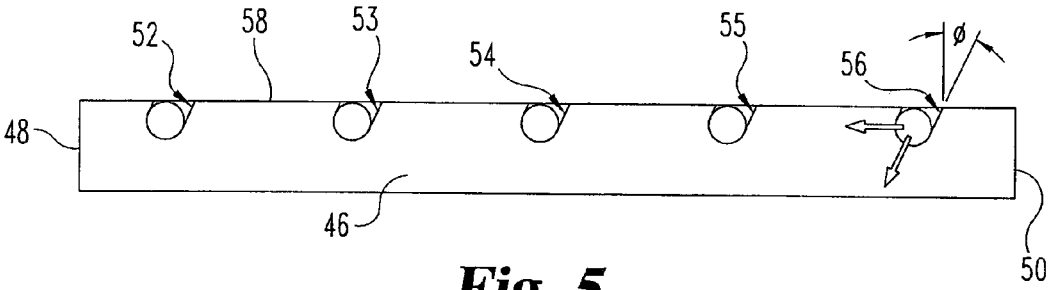
FIG. 5 is an enlarged cross sectional view taken on lines 6-6 of FIG. 2.

Upon placing the reinforcing fiber 32 within the groove 28, its inherent stiffness causes it to want to straighten out and to expand outward to abut the radially outermost portion 44 as represented by the arrows in FIG. 5. In one form of the present invention the fiber fits closely within the groove 28. In one form the reinforcing fiber is resiliently urged against the side wall 38. A typical non-limiting example of the stiffness of a reinforcing fiber will be exhibited by it having a modulus of $58\times10^6$ psi. However, other stiffness parameters are fully contemplated herein. Thus, a result is that the reinforcing fiber 32 is self-retained within the groove 28 by its expansion against the sidewall 38. In one form a portion 44*a* (FIG. 4) overlays part of the reinforcing fiber 32 and functions to limit movement of the fiber from the groove 28 in a direction substantially perpendicular to the face 30.

Figure 6:
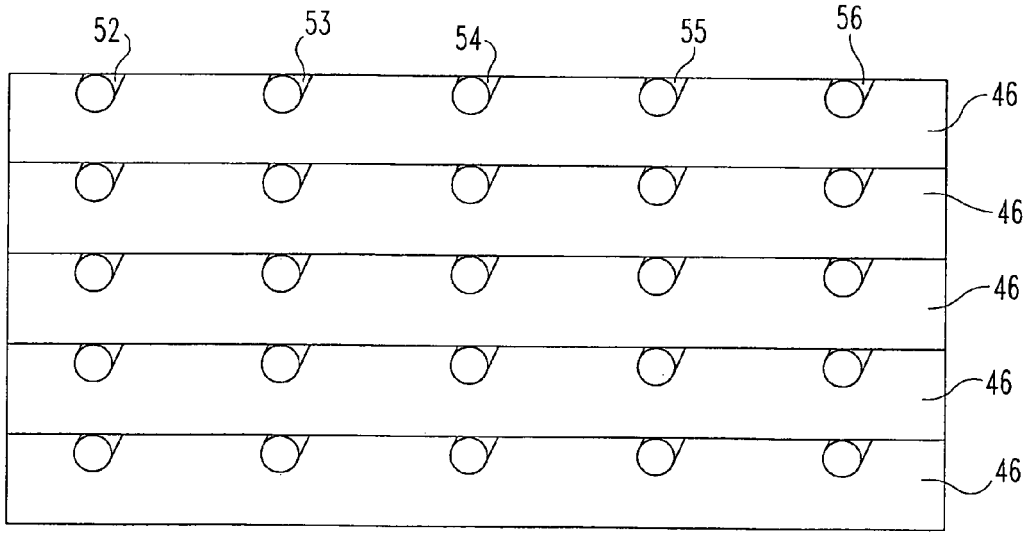
FIG. 6 is an illustrative cross-sectional view of a plurality of preforms of FIG. 5 arranged in a stack.
Figure 7:
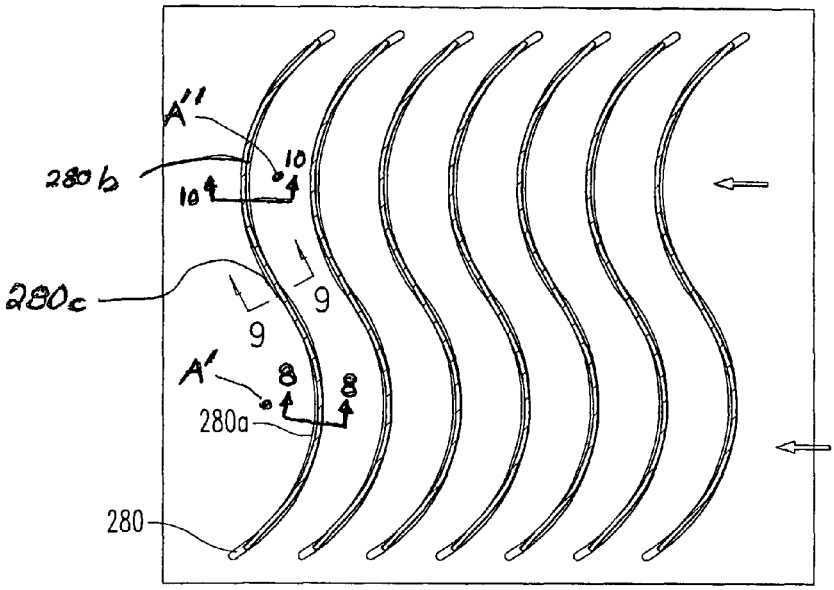
FIG. 7 is an illustrative plan view of a metal matrix sheet including a plurality of grooves with a reinforcing fiber disposed therein.

In one form the depth of groove 28 from the face 40 is sized to be deep enough to just accommodate the size of the reinforcing fiber 32 therein. However, other groove depths are contemplated herein. Referring to FIGS. 2 and 6, the reinforcing fiber, once laid in grooves 52-56, is self-retained so that a plurality of sheets 46 can be stacked for consolidation without resorting to any substantial quantity of glue/binder or auxiliary mechanical means to hold the fibers in place during processing. As set forth previously, the configuration of the groove shown in FIG. 5 can be employed in a groove configuration of concentric circles as shown in FIG. 2 and FIG. 5. In each case the grooves 52-56 have a cross-sectional configuration substantially like the features of FIG. 5.

With reference to FIGS. 7-10 there is illustrated one embodiment of a plurality of curved grooves 280 formed in the sheet of matrix material. In the illustrative embodiment in FIGS. 7-10 the groove 280 is substantially s-shaped and the side walls 340 and 380 are oriented at an angle ϕ which generally changes direction with the curvature of the groove. The groove 280 is not limited to the particular configuration set forth in the figures and may be shaped to a variety of configurations as required by the system design. Groove 280 includes a curve portion 280*a* formed about a center A' and another curve portion 280*b* formed about a center A". The curve portions 280*a* and 280*b* of groove 280 meet at an interface portion 280*c*.

Figure 8:
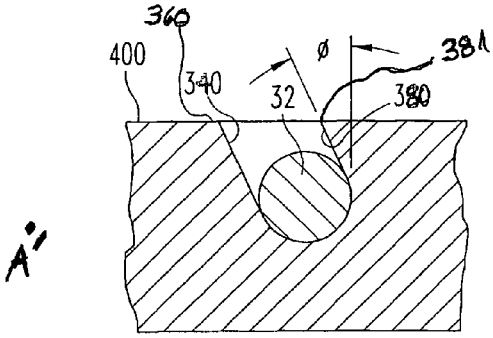
FIG. 8 is a cross-sectional view taken along lines 8-8 of FIG. 7.

With reference to FIG. 8, there is illustrated a cross-sectional view taken through lines 8-8 of the curve portion 280*a*. The description of the portion of the groove 280*a* is a mirror image of the groove set forth with reference to FIG. 4. However, the parameters and material discussed with reference to the embodiments associated with FIGS. 2-4 are applicable to the embodiments set forth in FIGS. 7-10 and the text will generally not be repeated herein. Groove portion 280*a* includes a radially inward side wall 340, relative to axis A', extending to an edge 360 and a radially outward side wall 380, relative to axis A' extending to an edge 381. The radially outward side wall 380 is located further from axis A' than the radially inward side wall 340. Each of the edges 360 and 381 are located at the face 400 of the sheet of matrix material.

Figure 9:
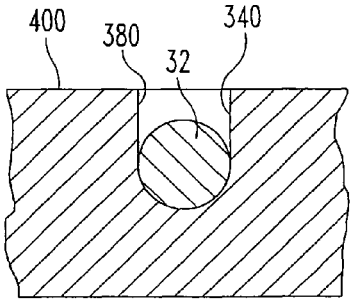
FIG. 9 is a cross-sectional view taken along lines 9-9 of FIG. 7.

With reference to FIG. 9, there is illustrated a cross-sectional view taken through lines 9-9 of the groove 280. The interface portion 280*c* includes substantially parallel side walls 380 and 340. In one form the interface portion 280*c* transitions gradually from the configuration of curve portion 280*b* to the substantially parallel side wall region and then transitions gradually to the curve portion 280*a*.

Figure 10:
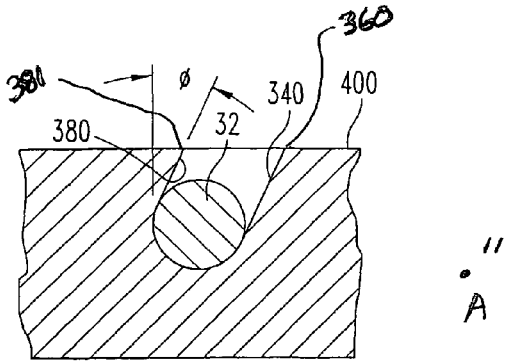
FIG. 10 is a cross-sectional view taken along lines 10-10 of FIG. 7.

With reference to FIG. 10, there is illustrated a cross-sectional view taken through lines 10-10 of the curve portion 280*b*. The portion of the groove 280*a* is substantially similar to the groove set forth with reference to FIG. 4 and the parameters and material discussed with reference to the embodiments of FIGS. 2-4 are applicable to the embodiments set forth in FIGS. 7-10 and the text will generally not be repeated herein. Groove portion 280*b* includes a radially inward side wall 340, relative to axis A", extending to an edge 360 and a radially outward side wall 380, relative to axis A" extending to an edge 381. The radially outward side wall 380 is located further from axis A' than the radially inward side wall 340. Each of the edges 360 and 381 are located at the face 400 of the sheet of matrix material.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of the word preferable, preferably, or in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

The invention claimed is:

1. A matrix composite preform comprising:

a metallic or intermetallic body having an outer surface with a groove formed therein and having a first portion of the groove extending about an axis, said first portion defined by a first sidewall and a second sidewall that are both oriented at an acute angle relative to said outer surface, said second sidewall is located further from said axis than said first sidewall; and a fiber reinforcement is located in said first portion of the groove and internally biased against said second sidewall.

2. The matrix composite preform of claim 1, wherein said first portion extending completely around said axis.

3. The matrix composite preform of claim 1, wherein said first portion extending partially around said axis.

4. The matrix composite preform of claim 1, wherein a portion of said second sidewall overhanging a part of the fiber reinforcement to limit movement of said fiber reinforcement.

5. The matrix composite preform of claim 1, wherein said groove is one of a circular or spiral shape.

6. The matrix composite preform of claim 1, wherein said groove defines a plurality of concentric grooves.

7. The matrix composite preform of claim 1, wherein said body defines a piece of foil.

8. The matrix composite preform of claim 1, wherein a portion of said second sidewall extending over a part of the fiber reinforcement in said first portion;

wherein said fiber reinforcement is of a substantially similar size and shape as said groove; and wherein said fiber reinforcement is biased against said second sidewall due to the fiber reinforcement seeking to straighten.

9. The matrix composite preform of claim 1, wherein said groove includes a second portion extending about a second axis;

wherein said second portion of the groove defined by said first sidewall and said second sidewall that are both oriented at a second acute angle relative to said outer surface, said first sidewall is located further from said second axis than said second sidewall;

and said fiber reinforcement is located in said second portion of the groove and internally biased against said first sidewall.

10. The matrix composite preform of claim 9, wherein a portion of said first sidewall overhanging a part of the fiber reinforcement to limit movement of said fiber reinforcement.

11. The matrix composite preform of claim 1, wherein said acute angle is within a range of 5.degree. to 25.degree.

12. A preform comprising:

a metallic or intermetallic material having a substantially planar outer surface with at least one groove formed therein about an axis;

a reinforcing fiber located within said at least one groove; and said at least one groove including fiber retention means for retaining said reinforcing fiber therein.

13. The preform of claim 12, wherein said fiber retention means including a shoulder extending from said material and overhanging a portion of said reinforcing fiber.

14. The preform of claim 12, wherein said at least one groove is formed at an acute angle in said material.

15. The preform of claim 12, wherein said material is defined by foil.

16. The preform of claim 12, wherein said fiber retention means including a shoulder overhanging a portion of said reinforcing fiber;

wherein said at least one groove is formed at an acute angle relative to an axis perpendicular to said outer surface; and wherein said sheet is defined by foil.

17. The preform of claim 12, wherein said material having a thickness within a range of about 0.005 inches to about 0.015 inches;

wherein said fiber retention means retains said reinforcing fiber within said at least one groove free of any glue or additional mechanical structure not formed integral with said material.

* * * * *